United States Patent [19]

Jarvis

[11] 4,195,451

[45] * Apr. 1, 1980

[54] MODULAR STAND CONSTRUCTION SYSTEM

[75] Inventor: Barry M. F. Jarvis, Snitterfield, England

[73] Assignee: Exhibition Showplace Services Limited, Stratford-On-Avon, England

[ * ] Notice: The portion of the term of this patent subsequent to Jul. 25, 1995, has been disclaimed.

[21] Appl. No.: 890,926

[22] Filed: Mar. 28, 1978

Related U.S. Application Data

[63] Continuation-in-part of Ser. No. 776,723, Mar. 11, 1977, Pat. No. 4,102,087.

[51] Int. Cl.[2] ..... E04H 3/12

[52] U.S. Cl. ..... 52/9; 52/8; 52/36

[58] Field of Search ..... 52/8, 6, 9, 182, 36, 52/184, 191, 188; 182/178; 297/331, 335, 336

[56] References Cited

U.S. PATENT DOCUMENTS

| | | | |
|---|---|---|---|
| 1,458,866 | 6/1923 | Wetzel | 52/182 X |
| 1,744,137 | 1/1930 | Oberdorfer et al. | 52/182 |
| 1,875,115 | 8/1932 | Oberdorfer | 52/191 X |
| 1,993,530 | 3/1935 | Schaffer | 297/335 |
| 2,287,561 | 6/1942 | Page et al. | 52/8 X |
| 2,295,311 | 9/1942 | Uecker et al. | 52/8 |
| 2,611,422 | 9/1952 | Roney | 52/9 X |
| 2,636,225 | 4/1953 | Jackson | 52/191 |
| 3,025,106 | 3/1962 | Evans et al. | 52/9 X |
| 3,117,350 | 1/1964 | Margadant | 52/191 X |
| 3,194,601 | 7/1965 | Hoven et al. | 297/336 X |
| 3,289,367 | 12/1966 | Mackintosh | 52/191 |
| 3,352,069 | 11/1967 | Curra, Jr. | 52/9 |
| 4,000,586 | 1/1977 | Vance et al. | 52/9 |
| 4,063,392 | 12/1977 | Van Ryn | 52/9 |
| 4,102,087 | 7/1978 | Jarvis | 52/9 |

FOREIGN PATENT DOCUMENTS

| | | | |
|---|---|---|---|
| 548198 | 10/1957 | Canada | 182/178 |
| 15892 | 12/1955 | Fed. Rep. of Germany | 52/6 |
| 1069369 | 11/1959 | Fed. Rep. of Germany | 182/178 |
| 908249 | 4/1946 | France | 297/236 |
| 1083500 | 1/1955 | France | 52/6 |
| 542564 | 4/1956 | Italy | 52/6 |
| 898121 | 6/1962 | United Kingdom | 52/6 |
| 1420615 | 1/1976 | United Kingdom | 52/9 |

*Primary Examiner*—Leslie Braun

*Attorney, Agent, or Firm*—Weingarten, Maxham & Schurgin

[57] ABSTRACT

A transportable stand construction system generally comprised of a plurality of seat modules. The system includes a support frame, support means on the support frame to be spaced from and normally parallel to a surface on which the system rests, and a floor-carrying member which is part of the seat module. Connecting means are arranged adjacent a rear end of the floor-carrying member and are locatable on the support means to position the rear end of the seat module substantially horizontally. The front end of the floor-carrying member is arranged to be supported directly by the surface beneath the system or by support means of a further support frame to be arranged at a lower level than the support means of the first support frame. The system also normally includes modular step members to provide gangways spaced at predetermined distances by a series of the seat modules.

13 Claims, 12 Drawing Figures

FIG. 11.
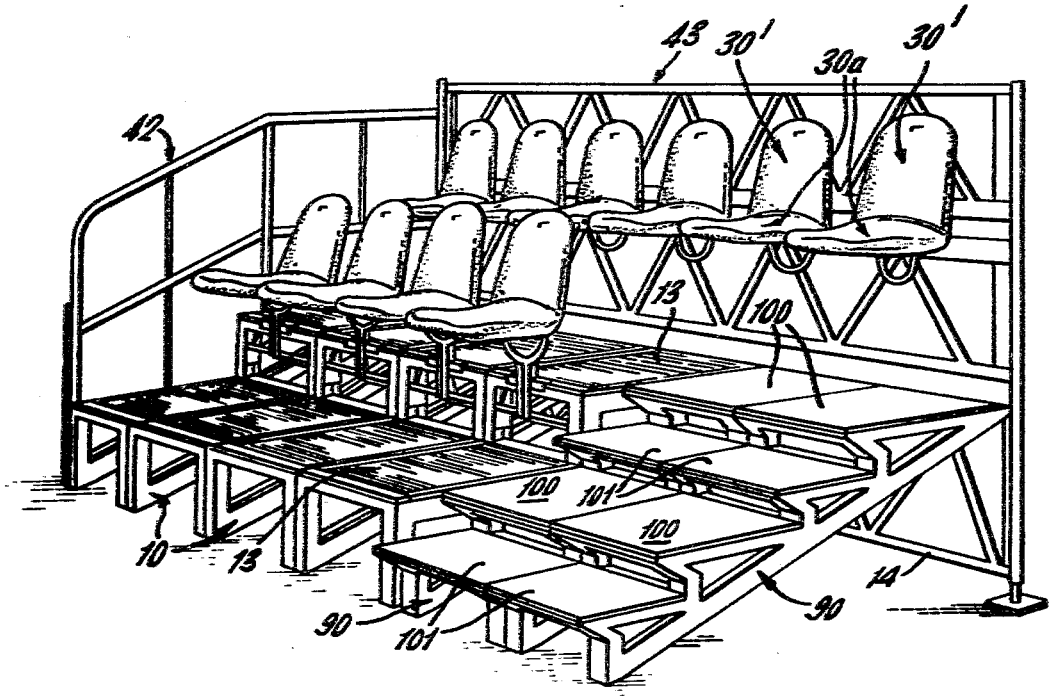
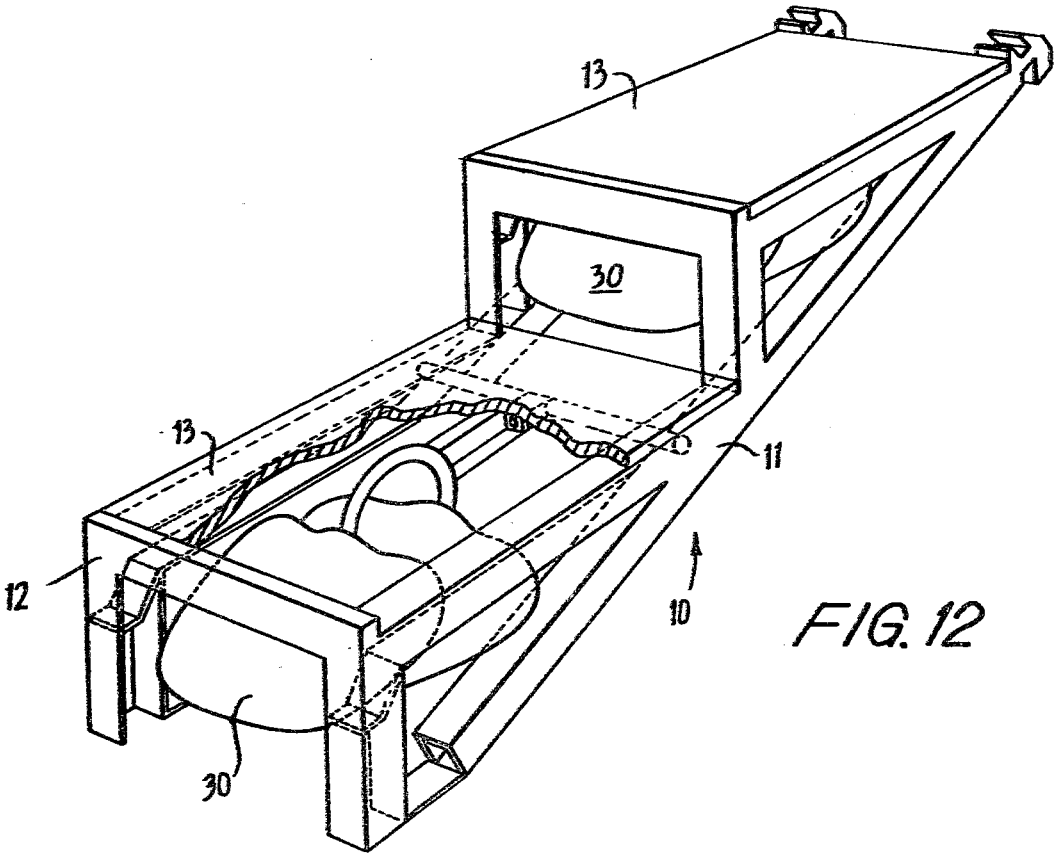
FIG. 12

MODULAR STAND CONSTRUCTION SYSTEM

CROSS REFERENCE TO RELATED APPLICATION

This is a continuation-in-part of U.S. patent application Ser. No. 776,723 filed Mar. 11, 1977, now U.S. Pat. No. 4,102,087.

FIELD OF THE INVENTION

The invention relates to an improved stand construction system and is particularly concerned with a system constructed or to be constructed from a plurality of pre-formed and modular components.

DISCUSSION OF THE PRIOR ART

Various systems are known for constructing stands which utilize frame-like units. A common disadvantage of such systems is that they require a large number of separate components and assembly is somewhat difficult. Furthermore, where seats are to be included, the seats are often of a plank-type which not only add to the number of separate components required, but are uncomfortable to sit on for long periods. Some systems utilize multiple-seat units which provide more comfortable seating. However, the units are bulky to stow, and difficult to handle and erect. An object of the invention is to provide a stand construction system which mitigates the foregoing disadvantages.

SUMMARY OF THE INVENTION

According to the invention, a stand construction system includes a support frame which has support means to be spaced from a surface on which the system rests, and a floor-carrying member having connecting means adjacent a rear end thereof arranged to locate on the support means to position said rear end substantially horizontally, the front end of the member being arranged to be supported directly by the surface or by support means of a further support frame to be arranged at a lower level than the support means of the first said support frame.

Where a further support frame is provided, the two support frames are preferably arranged to be interconnected by side frames which will extend between ends of one support frame and adjacent ends of the other support frame. In such a case, the ends of the lower support frame are preferably arranged to be connected directly to respective ends of the side frames, and the ends of the first said support frame are preferably arranged to be connected to the respective opposite ends of the side frames by means of spacer members, or by ends of further side frames extending toward adjacent ends of an additional support frame for supporting another floor-carrying member.

Preferably, three or more floor-carrying members are to be arranged one behind the other to form a stepwise structure rising from front to rear in the well recognized manner of a grandstand. In such a case, the rear end of each floor-carrying member may be arranged to locate the adjacent front end of the next rear floor-carrying member to inhibit removal of the or each floor-carrying member positioned intermediate the front and rearmost floor-carrying members.

Side safety rails may be positioned along sides of the floor-carrying members and a rear safety rail may be positioned along the rear of the rearmost floor-carrying member, the side rails being arranged to be supported by means of rail supports locatable on said side frames or said spacer members. The rear safety rail may comprise two support frames which may themselves be supported one above the other by means of legs which locate on said side frames or said spacer members. The legs may be arranged to interconnect the rear ends of the side safety rails and the adjacent ends of the rear safety rail.

Preferably, each floor-carrying member is arranged to carry one or more seats. Each seat may be collapsible and movable between a stowed position beneath a floor on the floor-carrying member and an erected position above the floor. The seat may include a runner captive in a slide on the floor-carrying member, the runner being arranged to move from one end of the slide into a well at the other end of the slide when the seat is moved from the stowed position to the erected position. The runner is preferably retained at said one end of the runner by clip means when the seat occupies the stowed position. Preferably, the seat frame includes a retaining member which cooperates with means on the floor-carrying member when the seat is erected and which, together with the runner positioned in the well, is arranged to retain the seat in its erected position. The seat may include a backrest which defines a recess for receiving a complementary shaped extension of a seat portion when the seat is in its erected position so that the backrest forms substantially a continuation of the extension. Where rear safety rails are provided, a plurality of seats may be mounted on a support which is arranged to be carried by the rear safety rail.

The invention also includes a stand made with a stand construction system according to any of the five immediately preceding paragraphs.

The seat modules are normally comprised of two parallel beams, floor supports, floor elements, two seats, and the other above-enumerated elements with the seat and its movable connection to the module.

In one embodiment, step modules are provided as part of the stand which are interchangeable with the seat modules to form gangways or stairs between groups of seats. Each step module would normally comprise a floor-carrying member including two parallel beams as in the seat modules, four steps and four floor elements to provide the surfaces necessary for climbing up the grandstand and for moving from a row of seats to the stairway.

BRIEF DESCRIPTION OF THE DRAWING

The objects, advantages and features of the invention will be more readily appreciated from the following detailed description when read in conjunction with the accompanying drawing in which:

FIG. 11 is a perspective view of part of a stand incorporating a preferred form of step member; and FIG. 12 is a perspective view of a single module according to the invention showing the seats in stowed position.

DESCRIPTION OF THE PREFERRED EMBODIMENTS

Figure 1:
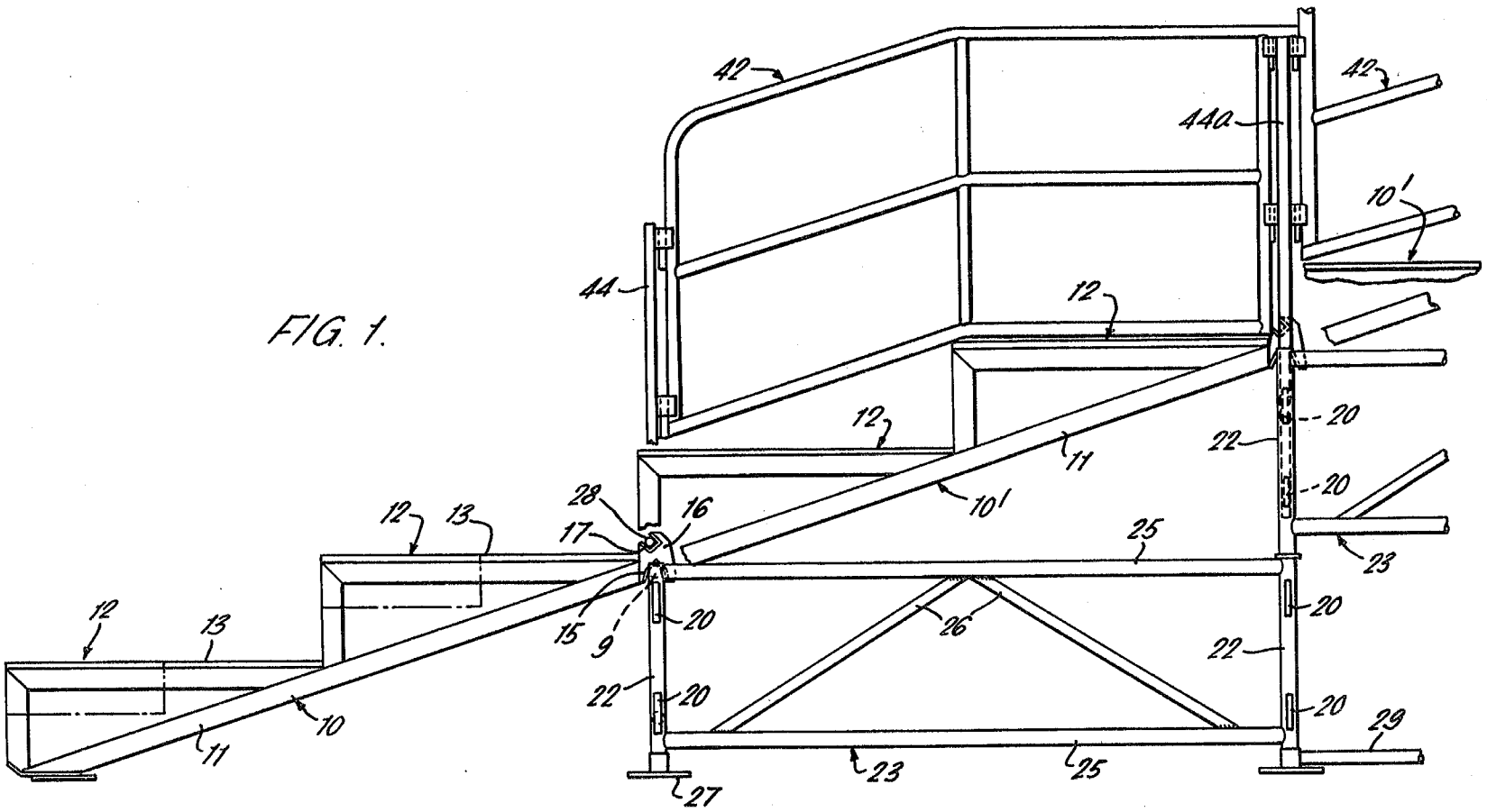
FIG. 1 is a side elevation of an assembly including floor-carrying members, support frames and side frames.
Figure 3:
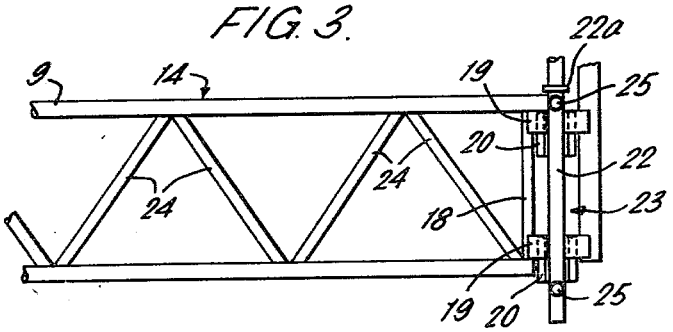
FIG. 3 is a view looking in the direction of Arrow A in FIG. 2 and illustrates one of the support frames in detail.
Figure 4:
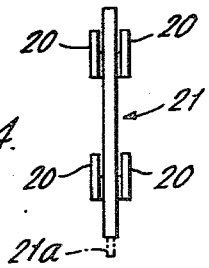
FIG. 4 illustrates a spacer leg.

A floor-carrying member 10 comprises two parallel beams 11 each of which is welded to floor supports 12 as viewed in FIG. 1. Floor boards 13 extend between the upper surfaces of the supports 12 and will occupy horizontal planes when the floor-carrying member is assembled in the seating system. The front end of the floor-carrying member 10 is arranged to rest on the ground and its rear end is supported horizontally by a tubular cross-member 9 of a support frame 14. The tube 9 locates in a channel 15 welded into recesses formed in upstanding plates 16 positioned at the rear ends of the beams 11. The plates 16 are also formed with further recesses in which is welded a further channel 17 for locating another floor-carrying member 10 as will be hereinafter described. Each end of the support frame 14 is provided with an end member 18 (see FIG. 3) which carries two sockets 19. The sockets 19 locate two pegs 20 which are mounted on a leg 22 at one end of a rearwardly extending side frame 23. The side frame has two legs 22 interconnected by members 25, and each leg carries additional pegs 20 to enable two support frames 14 to be interconnected end-to-end by the side frame 23. The support frame 14 is braced by struts 24, and the side frames 23 are braced by struts 26. As shown in FIG. 1, each side frame 23 is supported on the ground by two feet 27 in which the legs 22 locate. The rear legs 22 of the side frame 23 spigotally locate the lower ends of front legs 22 of further side frame 23 which also extend rearwardly. The legs 22 of the further side frames support a further support frame 14 to enable another floor-carrying member 10 to be placed in position behind the front floor-carrying member 10. As shown in FIG. 1, the front end of the other floor-carrying member 10 is provided with a transverse tube 28 which locates in the channel 17 of plate 16. After locating the tube 28, the other floor-carrying member 10 is allowed to pivot downwardly about the axis of the tube and will come to rest with its channel 15 located on the tube 9 of the further support frame. The channel 17 faces generally forwardly and prevents the further floor-carrying member 10 from being removed by lifting it vertically. As will be appreciated, the rear end of the further side frame 23 will require support from the ground, and this can be provided either by another side frame positioned on the ground, or by a spacer leg 21 shown in FIG. 4 having its lower end supported by a foot 27. The spacer legs 21 are of similar construction to the legs 22 of the side frames 23 and are capable of locating the ends of support frames 14 on pegs 20 on the legs. The dimensions of the floor-carrying members 10 and support frames 14 are chosen so that a convenient number of floor-carrying members 10 (for example, six) can rest side-by-side on one support frame 14. The feet 27 may be interconnected by a bracing tube 29 for additional stability and ease of assembly.

Figure 2:
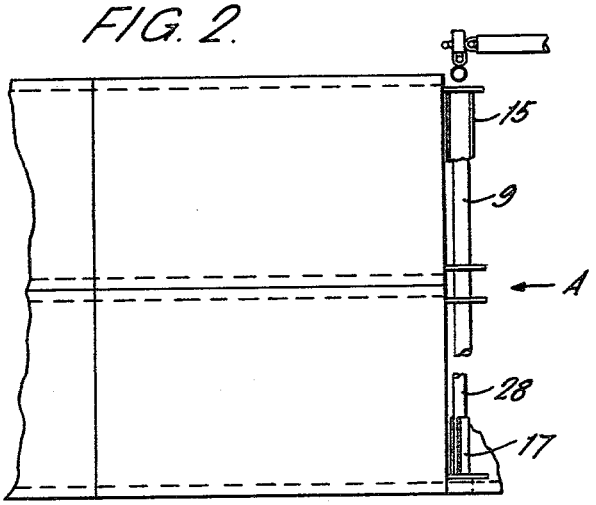
FIG. 2 is a plan view of part of the floor-carrying member shown in FIG. 1.
Figure 5:
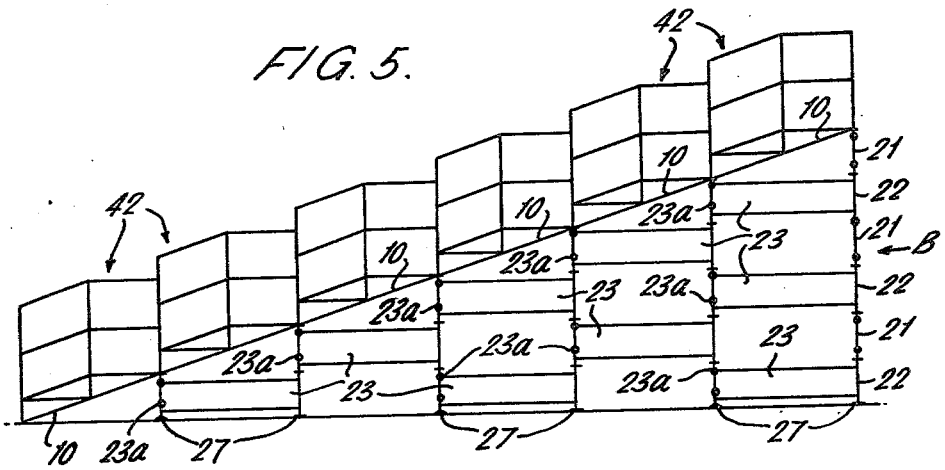
FIG. 5 is a diagrammatic side elevation illustrating the manner in which the system can be used to construct a stand.
Figure 6:
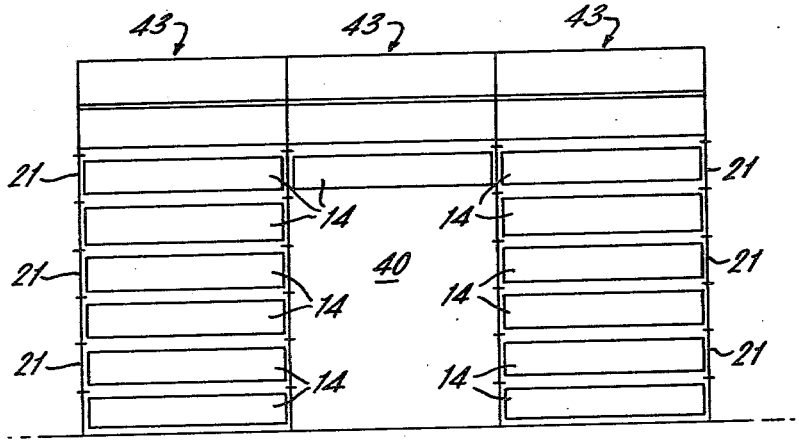
FIG. 6 is a view looking in the direction of Arrow B in FIG. 5.

FIGS. 5 and 6 illustrate diagrammatically a typical grandstand which can be constructed using a system in accordance with the invention. The support frames 14 and side frames 23 are erected as described with reference to FIGS. 1, 2 and 3 until the required number of tiers have been erected. Starting from the front, floor-carrying members 10 are then placed in position on the erected framework. The lower rearmost side frames 23 shown in FIG. 5 rest on feet 27. Spacer legs 21 having spigots 21*a* thereon (as shown in broken lines in FIG. 4) interconnect the rear leg 22 of the lower side frames with the rear legs of the side frames 23 arranged above them. Spacer legs 21 also interconnect rear legs 22 of the upper rearmost side frames 23 and the adjacent side frames below, and further spacer legs 21 are used to carry a support frame 14 for supporting the rear end of each rearmost floor-carrying member 10. Further support frames 14 extend between the other spacer legs 21 and horizontally between the side members 23 where indicated by circles 23*a*. As shown in FIG. 6, two bays of erected components may be interconnected by one or more additional support frames 14 to define an opening 40. Such additional support frames 14 may also support floor-carrying members 10. Side and rear safety rails indicated generally at 42 and 43 respectively may be added after erection of the system has been completed. Further bays may be added if required.

Each side rail 42 (see FIG. 1) is supported at its forward end by a rail support 44 which locates on the pegs 20 of the side frame leg 22 immediately below. The rear end of each side rail 42 is similarly supported either by a rail support 44 or by a modified rail support 44*a* by which the rear end of the side rail can be connected to the forward end of an adjacent side rail.

Each rear rail 43 (see FIG. 7) comprises two support frames 14 supported by means of extended legs 45. Each leg 45 has four sets of pegs 20 spaced to support the two frames 14 as shown. The legs 45 spigotally locate in the upper ends of the spacer legs 21 and may support two adjacent rear rails 43. The two legs 45 at the outer ends of the rear rails 43 may support the rear ends of the rearmost side rails 42.

Figure 8:
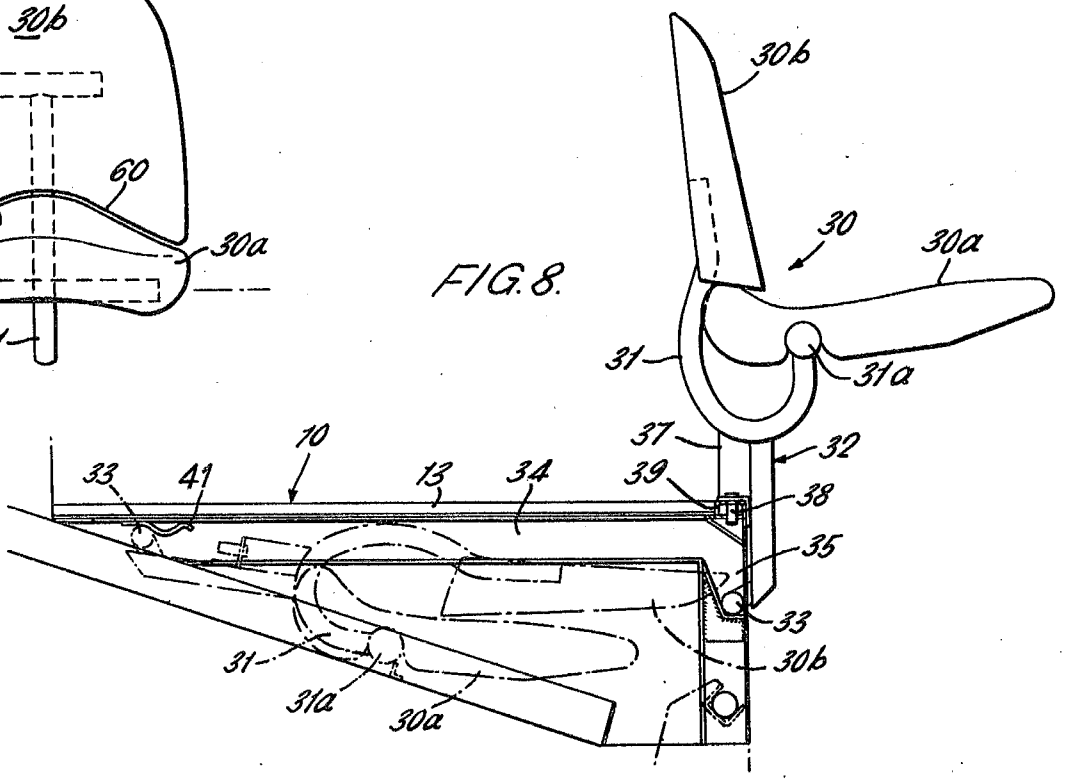
FIG. 8 illustrates the manner in which a seat can be mounted on a floor-carrying member.

Referring now to FIG. 8, each floor-carrying member 10 can be adapted to house one or more collapsible seats indicated generally at 30. Each seat includes a seat portion 30*a* and a backrest 30*b* interconnected by a tubular frame 31. The seat portion 30*a* is pivoted to the frame 31 at 31*a*. The frame 31 is welded to a leg 32 the free end of which is welded to a runner 33. The runner 33 locates in a slide 34 on the floor-carrying member 10 which is formed with a well 35 at its forward end. The leg 32 includes a flange 37 which is welded to a pin 38. A spring retaining clip 41 is arranged at the rear end of the slide 34 and snaps over the runner 33 when the seat is stowed in its collapsed condition as shown in broken lines. To erect the seat, the seat is urged forward to release the runner from the spring clip and is withdrawn from beneath the floor boards 13 so that the runner 33 slides into the well 35. The seat is then pivoted upwardly about the captive runner until the pin 38 aligns with a hole formed in a metal cross-member 39 along the front of the floor-carrying member 10. The seat is then lowered so that the pin 38 enters the hole as shown in FIG. 8 and retains the seat in its erected position. It is envisaged that two rows of six seats may be carried by six floor-carrying members 10, arranged side-by-side on the support members 14.

Figure 7:
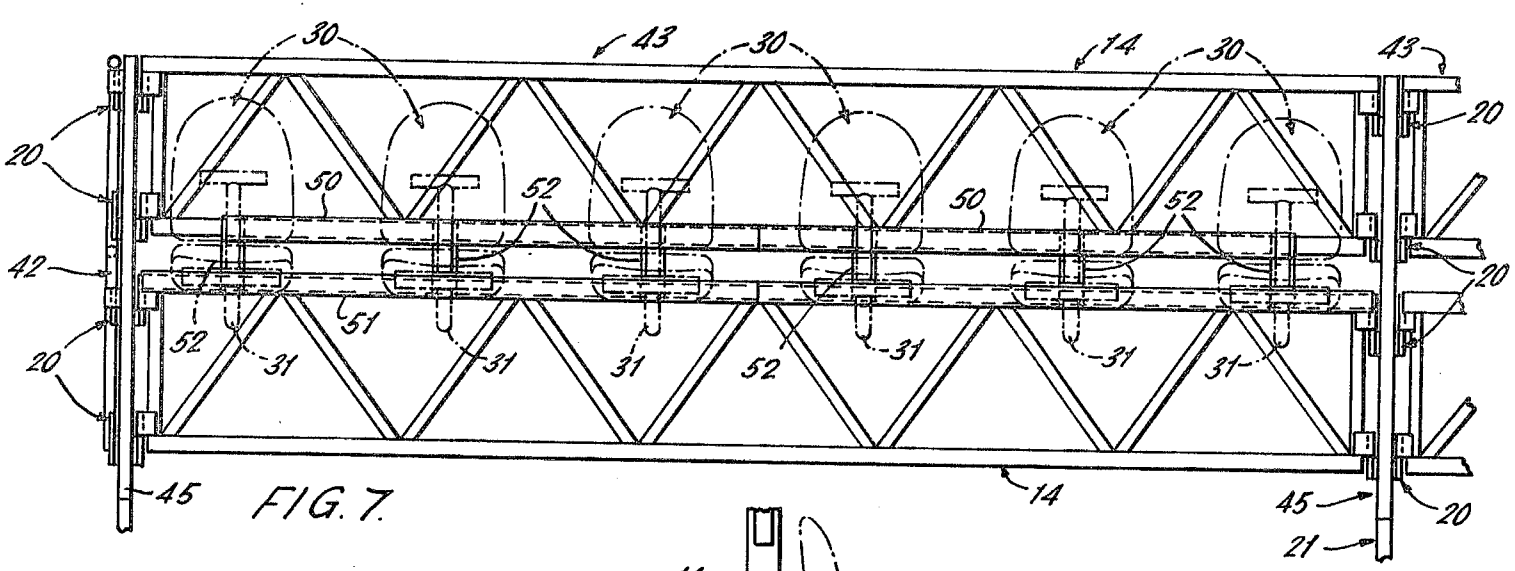
FIG. 7 is a view of a preferred form of rear safety rail.
Figure 9:
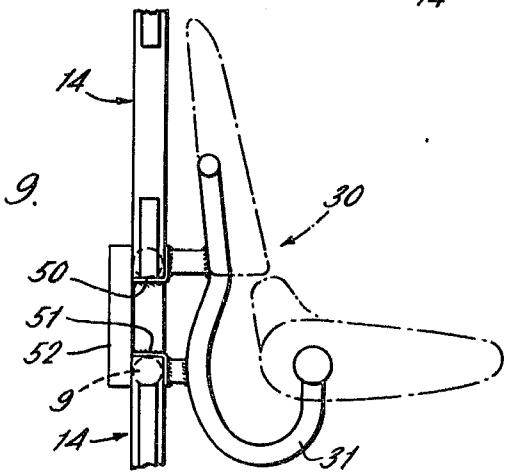
FIG. 9 shows a rear safety rail seat mounting.

As shown in FIGS. 7 and 9 each rear rail 43 may be arranged to support a row of six seats. Each of the seats 30 has its frame 31 welded to upper and lower supports 50, 51 respectively which are interconnected at intervals by vertical spacers 52. The upper and lower seat supports fit between the two support frames 14 and maintain the seat frames 31 in the position shown in FIG. 9. During assembly of each rear rail 43, the lower support frame 14 is first located on the lower pegs 20 of the associated legs 45. The lower seat support 51 is then placed in position on the tubular cross-member 9 of the lower support frame 14 and the upper support frame 14 placed in position so as to sandwich the seat supports 50, 51 between the two support frames. Preferably each set of seat supports 50, 51 carries three seat frames 31, and two sets of supports 50, 51 are sandwiched between the upper and lower support frames 14.

Figure 10:
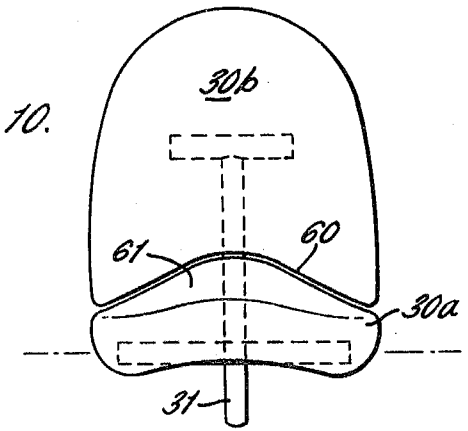
FIG. 10 is a front view of a preferred form of seat.

The seats may be of any convenient kind but we prefer to use a seat and backrest arrangement as shown clearly in FIG. 10. In FIG. 10, the backrest 30*b* is formed along the lower edge with an inverted V-shaped recess 60 which receives a complementary-shaped extension 61 of the seat portion 30*a*. Thus, when the seat is in the erected position, the backrest 30*b* forms substantially a continuation of the extension 61. This arrangement is particularly advantageous as the extension 61 provides ideal support for the lower part of the back of a person occupying the seat, and the transition between the seat portion 30*a* and the backrest 30*b* is almost imperceptible. The seat portions may be hollow and be formed from glass fibre reinforced plastics.

If desired the floor-carrying members 10 can support a number of steps as indicated in chain-dotted lines in FIG. 1 or as shown in FIG. 11. Such step members 10 can be located between selected floor-carrying members in the form of gangways to enable spectators to climb to the appropriate row of seats on the grandstand or can be positioned between the ground and the front row of seats. Where steps of the kind indicated in chain-dotted lines in FIG. 1 are used as gangways at the ends of or between rows of seats, a person walking along the floor boards 13 in front of a row of seats onto the steps has a relatively narrow area of step on which to stand. The person then has to turn on the narrow step and walk up or down the steps as appropriate and this could prove to be difficult. In FIG. 11 the modular step member (indicated at 90) has steps 100 which provide extra surface area on which to stand when leaving a row of seats. The next step down (101) has less depth than the step 100 but the depth has been found to be quite adequate to enable users to ascend or descend the steps without difficulty. The deeper step 100 also makes it easier for a person leaving the seats 30′ of the rearmost row to stand on the step below as the step 100 projects beyond the front of the seat portions 30*a*. Both the step members of the kind indicated in FIG. 1 and the step members 90 of FIG. 11 can be used to construct staircases inside the grandstand structure. Any number of the modular step members 90 can be arranged side-by-side or one behind the other to form terracing if desired and they assemble on the support frames 14 in the same manner as the floor-carrying members 10. The steps may terminate at an aisle unit or landing provided by floor boarding supported directly by beams 11 with the floor supports 12 omitted. If the grandstand is to increase in height incrementally rather than in the progressive manner illustrated in FIG. 5, non-sloping aisles should be provided between the rear end of one floor-carrying member 10 and the forward end of the next rearmost member 10. The units utilized to form aisles may also be used to form walkway ramps either internally or externally of the grandstand. A tower may be erected at the rear of the grandstand for use, for example, by television camera operators. Such a tower may conveniently be erected by utilizing further side frames 23, extending rearwardly from the grandstand, and associated support frames 14. Aisle units may be used to form a floor at the top of such a tower.

Adjustable spacer legs may be provided to enable the system to be erected on uneven ground.

Side frames 23 to be erected upon those which are supported by the feet 27 may be provided with rings 22*a* (see FIG. 3) adjacent the lower ends of their legs 22. The rings 22*a* prevent the removal of support frames from lower side frames in the erected structure.

The seat module 10 is shown independently in FIG. 12. It is comprised of two step-like elements on two parallel beams 11. The step-like elements include floor supports 12, and floor boards 3, as well as the mechanical members associated with the seat and its movement between erect and stowed positions. Normally there will be one seat on or in each step-like element. The seat 30 may be in the erect position for use, or in the stowed position beneath the floor boards and entirely within the triangular envelope created by the beams, floor supports and floor boards. With the seat thus enclosed and protected it is easily appreciated how the seat module can be handled and transported without damage, making this stand system truly transportable while at the same time providing a safe, easily erected, stable grandstand with comfortable seats.

The seating system described does not require the use of tools to aid erection, and is easier and quicker to erect than known systems due to the relatively small number of components required. Furthermore, the seats are more comfortable than the plank-type seating of certain known systems, and, unlike known multiple seating units, are not bulky to stow.

Although a checkered arrangement of support and side frames is shown in FIGS. 5 and 6, the frames could be arranged differently if desired.

Various components, such as the seat frame, may be die cast, thus avoiding the need to weld numerous components together.

What is claimed is:

1. A modular stand construction system comprising:
a support frame;
support means on said support frame to be spaced from a surface on which said system rests;
at least one floor-carrying member;
floor means mounted on said floor-carrying member;
connecting means adjacent a rear end of said floor-carrying member locatable on said support means to position said rear end substantially horizontally, said floor-carrying member having its front end arranged to be supported directly by the surface or by support means of a further support frame to be arranged at a lower level than the support means of the first said support frame;
at least one collapsible seat coupled to said floor means, said collapsible seat being engaged with said floor means when in an erect position and being movable from the erect position to a stowed position beneath said floor means; and
a modular step member defining a plurality of steps, one step of which has a greater surface area than the area of the next lower step, said modular step member being employed in said system interchangeably with said floor-carrying members to which are mounted said floor means and said collapsible seats to provide gangways between said seats.

2. The modular stand construction system recited in claim 1 wherein said modular step member comprises a floor-carrying member and floor means mounted on said floor-carrying member forming said steps, alternate ones of the steps on said modular step member having a greater surface area than the surface area of the intermediate steps.

3. The modular stand construction system recited in claim 2 wherein each said step of larger area extends partially over the rearward surface of each said intermediate smaller area step thereby facilitating the provision of larger area steps.

4. A modular stand construction system comprising:
a support frame;
support means on said support frame to be spaced from a surface on which the system rests;
at least one modular seat member comprising:
a floor-carrying member;
floor means mounted on said floor-carrying member; and
at least one collapsible seat coupled to said floor means, said collapsible seat being engaged with said floor means when in an erect position and being movable from the erect position to a stowed position beneath said floor means whereby said floor-carrying member and said floor means provide an envelope within the external dimensions of which said seat is fully enclosed when in the stowed position, thereby facilitating transportation and storage of said modular seat members while protecting said seat; and
connecting means adjacent a rear end of said floor-carrying member locatable on said support means to position said rear end essentially horizontal, said floor-carrying member having its front end arranged to be supported directly by the surface or by support means of a further support frame to be arranged at a lower level than the support means of the first said support frame.

5. The modular stand construction system recited in claim 4 wherein:
said floor-carrying member is further comprised of two parallel beams; and
said floor means comprises floor supports projecting upwardly from said parallel beams in step fashion, and floorboards resting across said floor supports.

6. The modular stand construction system recited in claim 5 wherein, when in said stowed position, said seat is confined within the envelope defined by said parallel beams, said floor supports and said floorboards.

7. The modular stand construction system recited in claim 4 wherein said modular seat member comprises two seat receiving envelopes and two collapsible seats adapted to be moved to a stowed position within each respective envelope.

8. The modular stand construction system recited in claim 4 and further comprising a modular step member defining a plurality of steps, one step of which has a greater surface area than the area of the next lower step, said modular step member being interchangeable in said system with one of said modular seat members.

9. A modular stand construction system comprising:
a first support frame;
a second support frame;
side frames extending between and interconnecting adjacent ends of said first and second support frames;
support means on said support frames to be spaced from a surface on which said system rests;
at least one floor-carrying member;
floor means mounted on said floor-carrying member;
connecting means adjacent a rear end of said floor-carrying member locatable on said support means to position said rear end substantially horizontally, said floor-carrying member having its front end arranged to be supported directly by the surface or by support means of a further support frame to be arranged at a lower level than the support means of said first support frame; and
at least one collapsible seat coupled to said floor means, said collapsible seat being engaged with said floor means when in an erect position and being movable from the erect position to a stowed position beneath said floor means, said seat member when in the stowed position being fully enclosed within the external dimensions of said floor-carrying member and said floor means to which said seat is engaged when in the erect position.

10. The modular stand construction system recited in claim 9 wherein said second support frame is lower with respect to the surface on which said system rests than is said first support frame, said second support frame being coupled directly to the respective ends of said side frames, said system further comprising:
spacer means for connecting the ends of said first, higher support frame to the respective opposite ends of said side frame;
wherein said system comprises at least three floor-carrying members arranged one behind the other.

11. The modular stand construction system recited in claim 10 wherein the rear end of each floor-carrying member is arranged to locate the adjacent front end of the next rearward floor-carrying member to inhibit removal of each floor-carrying member positioned intermediate the front and rearmost floor-carrying members.

12. The modular stand construction system recited in claim 10 and further comprising:
side safety rails positioned along sides of said floor-carrying members;
a rear safety rail positioned along the rear of the rearmost floor-carrying member; and
rail supports for said side rails, said rail supports being locatable on said side frames or said spacer means.

13. The modular stand construction system recited in claim 9 wherein at least some of said collapsible seats comprise:
a frame;
a runner mounted on said frame; and
a slide provided on said floor-carrying member in which slide said runner is captive, said runner being arranged to move from one end of said slide into a well at the other end of said slide when said seat is moved from the stowed position to the erected position.

* * * * *